US005715871A

United States Patent [19]

Covelli et al.

[11] Patent Number: 5,715,871

[45] Date of Patent: Feb. 10, 1998

[54] FRUSTOCONICAL DEVICE WITH INTERNAL RIBS FOR LOOM YARN FEEDERS

[75] Inventors: Marco Covelli, Occhieppo Inferiore; Giovanni Silmo Rubin, Biella, both of Italy

[73] Assignee: Nuova Roj Electrotex S.r.l., Biella, Italy

[21] Appl. No.: 666,396

[22] PCT Filed: Dec. 16, 1994

[86] PCT No.: PCT/EP94/04189

§ 371 Date: Jun. 24, 1996

§ 102(e) Date: Jun. 24, 1996

[87] PCT Pub. No.: WO95/18059

PCT Pub. Date: Jul. 6, 1995

[30] Foreign Application Priority Data

Dec. 29, 1993 [IT] Italy ..... MI93A2748

[51] Int. Cl.[6] ..... B65H 59/06; D01H 1/42

[52] U.S. Cl. ..... 139/452; 57/58.83; 57/354; 242/157 R; 242/128

[58] Field of Search ..... 57/58.83, 354; 139/452; 242/157 R, 172, 128

[56] References Cited

U.S. PATENT DOCUMENTS

| | | | |
|---|---|---|---|
| 2,170,194 | 8/1939 | Griggs | 242/128 |
| 3,094,835 | 6/1963 | Nimtz et al. | 57/354 |
| 3,199,806 | 8/1965 | Jenny | 242/128 |
| 3,203,642 | 8/1965 | Hirst | 57/354 |
| 4,471,917 | 9/1984 | Whisnant | 242/157 R |
| 5,329,755 | 7/1994 | Frentzel-beyme et al. | 57/354 |
| 5,605,297 | 2/1997 | Bruns | 242/157 R |

FOREIGN PATENT DOCUMENTS

| | | | |
|---|---|---|---|
| 0 449 068 | 3/1991 | European Pat. Off. | 139/452 |
| 0 567 045 | 4/1993 | European Pat. Off. | 139/452 |
| 814125 | 6/1959 | United Kingdom | 139/452 |
| 2081752 | 2/1982 | United Kingdom | 57/354 |

*Primary Examiner*—Andy Falik
*Attorney, Agent, or Firm*—Young & Thompson

[57] ABSTRACT

Device to control the yarn at the outlet of yarn feeders, particularly antiballoon device for weft yarn feeders of looms, of the type consisting of an element (10) having a substantially frustoconical surface. A plurality of ribs (11) project from the inner wall of said element, substantially extending along the generatrices of its surface.

9 Claims, 4 Drawing Sheets

FRUSTOCONICAL DEVICE WITH INTERNAL RIBS FOR LOOM YARN FEEDERS

BACKGROUND OF THE INVENTION

1. Field of the Invention

The present invention concerns a device to control the yarn at the outlet of yarn feeders, particularly an "antiballoon" device containing the weft yarn at the outlet of weft yarn feeders for looms.

More specifically, the invention arose from the need to set up an antiballoon device to be applied at the outlet of measuring weft feeders for fluid jet looms, particularly air looms, so as to stop the forming of balloons—which are quite frequent and create serious inconveniences—as a result of the yarn being unwound in défilé from such feeders.

There is known to be an increasingly widespread use of fluid jet looms, particularly air looms, for weaving a constantly rising number of different articles; it is also known that such looms work at increasingly higher speeds.

The higher working speeds determine an increase in the speed of weft yarn insertion and, consequently, a higher yarn unwinding speed from the winding unit of measuring weft feeder. The weft yarn is wound on said winding unit into successive turns, so as to form a yarn reserve, and is subsequently unwound therefrom in défilé, which often gives rise—due to high unwinding speed—to the forming of balloons.

The negative consequences of the forming of balloons are substantially the following:

- the unwinding weft yarn could rub against parts of the measuring weft feeder which should not be touched in formal unwinding conditions, with possibility for the yarn to get caught in such parts; and
- there could be an increase in the tension of the yarn being unwound, determined by the centrifugal forces acting on said yarn.

In practice, this determines irregular conditions in the weft yarn which do not allow it to regularly reach the side of the fabric being woven opposite to that of weft insertion.

Such irregular conditions can substantially occur in two ways:

- times taken for the weft yarn to reach the other side of the fabric, which are not constant in respect of the weft insertion cycle; and
- non perfect settlement of the weft yarn inserted in the loom shed.

2. Description of the Related Art

To overcome these drawbacks—which become more and more evident the higher the loom speed and the smaller the yarn count, due to increase in the centrifugal force action—it is known to use antiballoon devices consisting of hollow elements having an approximately frustoconical shape which, positioned downstream of the measuring weft feeder, perform the function of containing and controlling the balloon formed by the unwinding weft yarn.

FIG. 1 of the accompanying drawings shows an antiballoon device 1 according to known technique, applied just downstream of the measuring weft feeder 2; the weft yarn T—after having been drawn from the spool or reel R, and wound by the winding arm 4 onto the winding unit 3 of the feeder 2—is unwound from said unit 3 thanks to the main nozzle 5 mounted on the loom being fed by said feeder 2.

The antiballoon device 1 is fixed to the upper part of the measuring weft feeder 2 by way of a support bracket 6, which may eventually allow its adjustment in an axial sense so as to suitably vary the distance of the device 1 from the winding unit 3.

Nevertheless, the presence of the device 7 to stop the yarn T—which must forcedly be positioned close the area of the yarn outlet from the winding unit 3—makes it impossible totally envelop said winding unit 3, whereby there is still the possibility of a "residual" balloon (indicated by B in FIG. 1) being formed.

The inner surface of the antiballoon device 1 is moreover apt to create friction forces by rubbing of the weft yarn, hence increasing the tension of the yarn T at its outlet from the device 1, which may cause delays in the times taken for the weft yarn to reach the other side of the fabric being woven, or increases in the feeding pressure of the loom nozzle 5 to make up for the increased yarn resistance to unwinding and thus obtain correct times of weft yarn arrival at the other side of the fabric.

To overcome these drawbacks there are already known to be special configurations of the antiballoon device which tend to reduce friction between the yarn and the wall of said device. By way of example, the following configurations of the antiballoon device are illustrated with reference to FIGS. 2 to 4 of the accompanying drawings:

- FIG. 2 shows the device in the form of a frustoconical element with double taper;
- FIG. 3 shows the device approximately in the form of a semiellipsoidal element;
- FIG. 4 shows the device in the form of a frustoconical element, with its inner wall provided with projecting parts, generally of a more or less hemispherical shape and variably arranged over the whole, or over part of the surface of said wall.

This last known configuration of the antiballoon device is more appreciated, in that the projections arranged in the intrados of the frustoconical element tend to reduce the surface of contact with the weft yarn, correspondingly limiting the friction forces involved.

SUMMARY OF THE INVENTION

It has now been found that the forming of a residual balloon can be almost entirely prevented—simultaneously reducing to a minimum the friction forces acting on the weft yarn—by adopting antiballoon device of the last mentioned type, wherein the parts projecting from the intrados have a special and original configuration.

Said device forms the object of the present invention and consists of an element having a frustoconical surface, characterized in that a plurality of ribs project from its inner wall and substantially extend along the generatrices of its surface, genetrices known to be the set of lines which pass through the apex and along the surface of a cone or a frustrum thereof.

Preferably, said ribs are distributed in a uniform manner, or in sets, over the directrices of said surface, extending through at least, directrices known to be the periphery or circumference of a surface half of the length of the generatrices of said surface such as a cone.

BRIEF DESCRIPTION OF THE DRAWINGS

The invention will now be described in further detail, by mere way of non-limiting example, with reference to two preferred embodiments thereof, illustrated on the accompanying drawings, in which.

DESCRIPTION OF THE PREFERRED EMBODIMENTS

Figure 1:
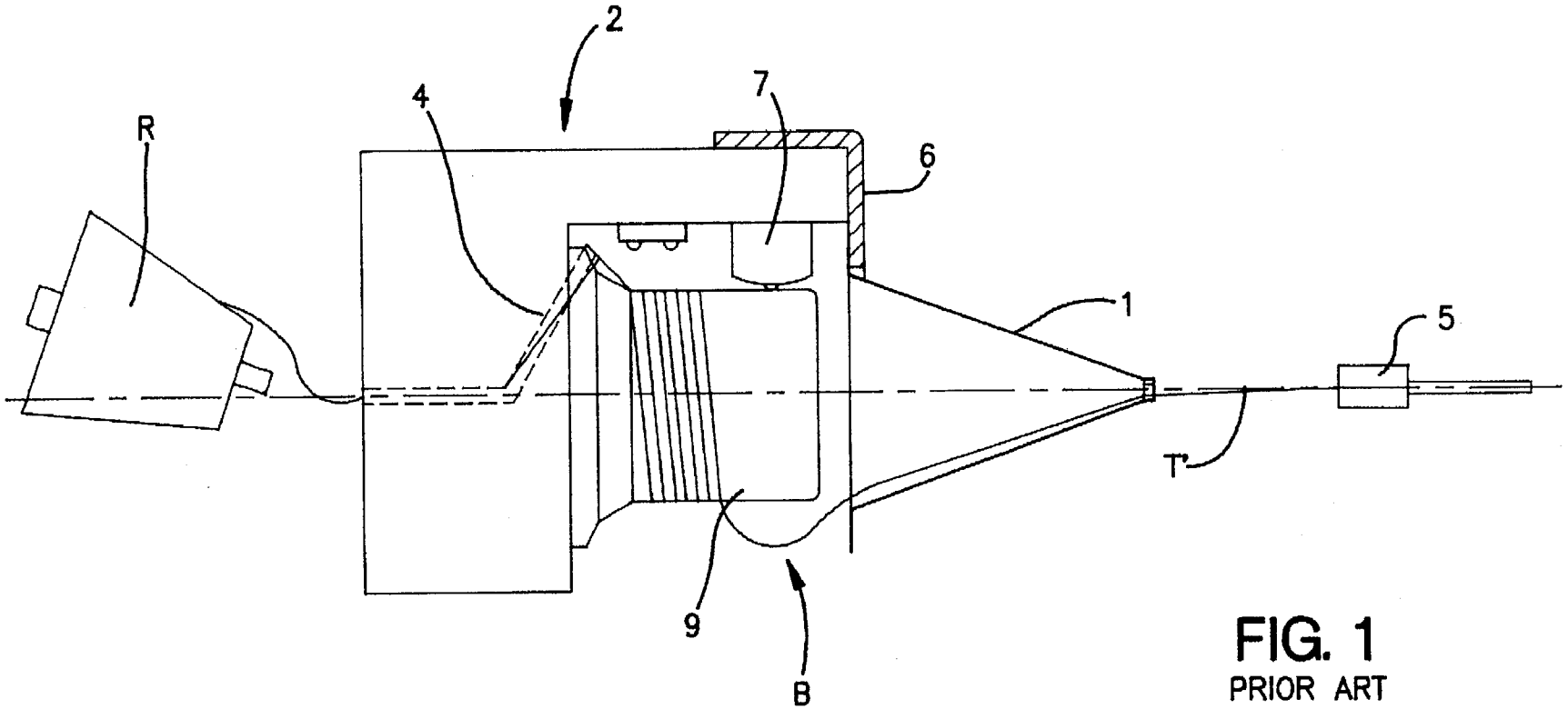
FIG. 1 PRIOR ART
FIG. 1 is a diagrammatic view of a yarn feeder equipped with an antiballoon device according to known technique.
Figure 2:
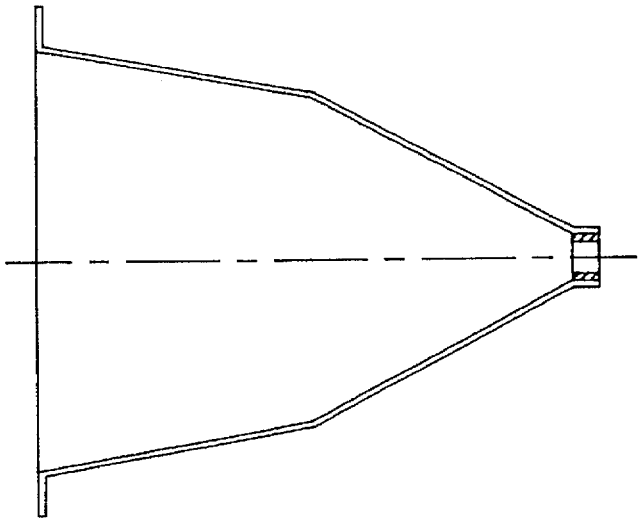
FIG. 2 PRIOR ART
FIGS. 2, 3 and 4 are external views of some known embodiments of antiballoon devices.
Figure 3:
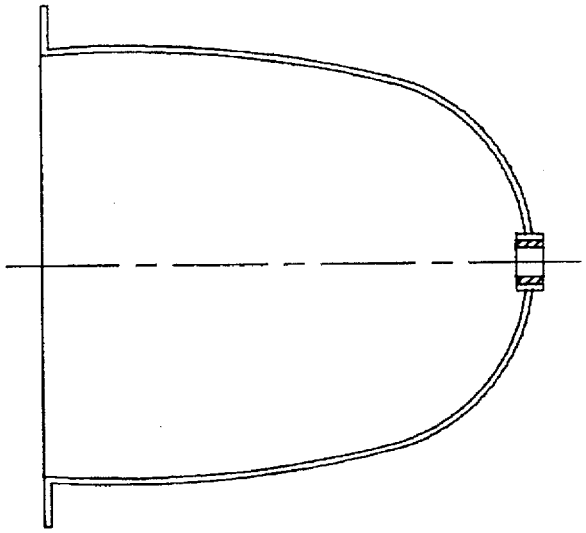
FIG. 3 PRIOR ART
Figure 4:
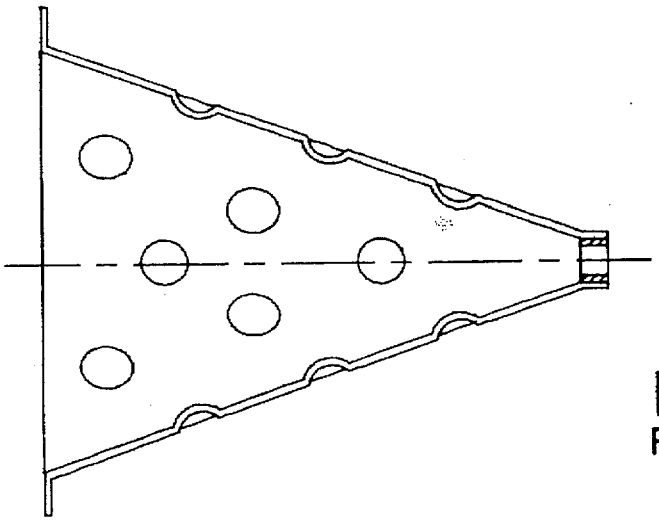
FIG. 4 PRIOR ART
Figure 5:
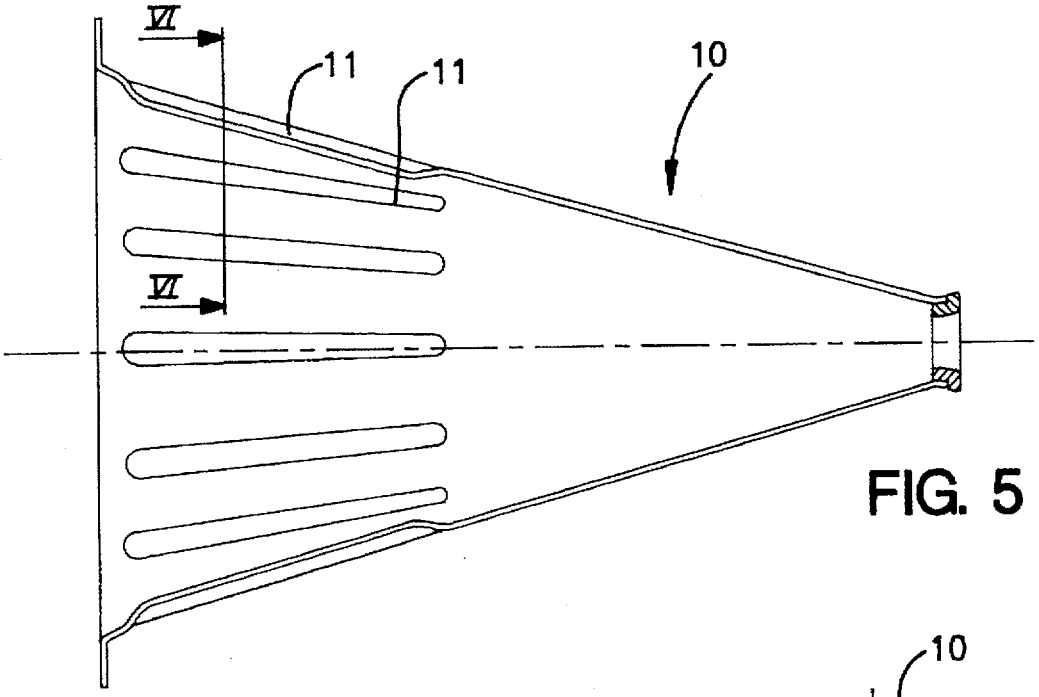
FIG. 5 is an external view of a preferred embodiment of the antiballoon device according to the present invention.
Figure 6:
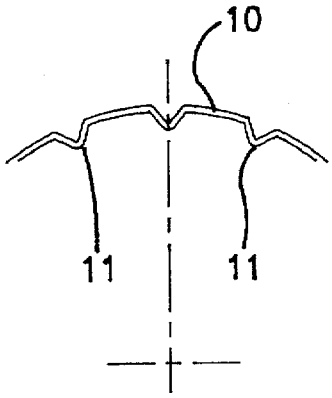
FIG. 6 is a part section view of the same device, along the line VI—VI of FIG. 5.

With reference to FIGS. 5 and 6 of the accompanying drawings, the antiballoon device according to the present invention consists of an element 10 having a frustoconical surface, onto the intrados of which there are formed a plurality of ribs 11 extending along generatrices of said surface, the ribs being distributed in a uniform manner over the directrices of said surface.

The ribs 11 extend over a considerable length of said frustoconical element 10 and are apt to project to a constant extent (as shown), or to a variable extent, from the intrados of said element 10; also their specification can be either constant or variable. Furthermore, the ribs 11 can extend exactly along the generatrices of the frustoconical surface of said element 10—as shown—or else they can be slightly inclined in respect of said generatrices.

The extension of the ribs 11 along the generatrices of the frustoconical surface of the element 10 defines, inside said element, an ideal low friction surface. In fact, thanks to such ribs, the weft yarn is prevented from contacting a wide surface of the element 10. At the same time,the forces generating through contact of the weft yarn with the ribs 11—having the aforespecified configuration—provide the advantage of drastically reducing the formation of a "residual" balloon between the winding unit of the weft feeder and the inlet to the antiballoon device.

The positive results obtained—as far as low tension of the weft yarn being unwound and, thus, possibility to insert the weft yarn into the loom shed in short times and with low levels of fluid pressure feeding the loom nozzles—undoubtedly lead to a greater economy in loom operation and guarantee a constant quality of the fabric.

Tests have proved that the use of an antiballoon device as that described heretofore allows, compared to conventional devices, to reduce the weft insertion times by about 4%, when using cotton with a Ne 20 count, and up to about 10%, when using thicker cotton with a Ne 5 count.

Figure 7:
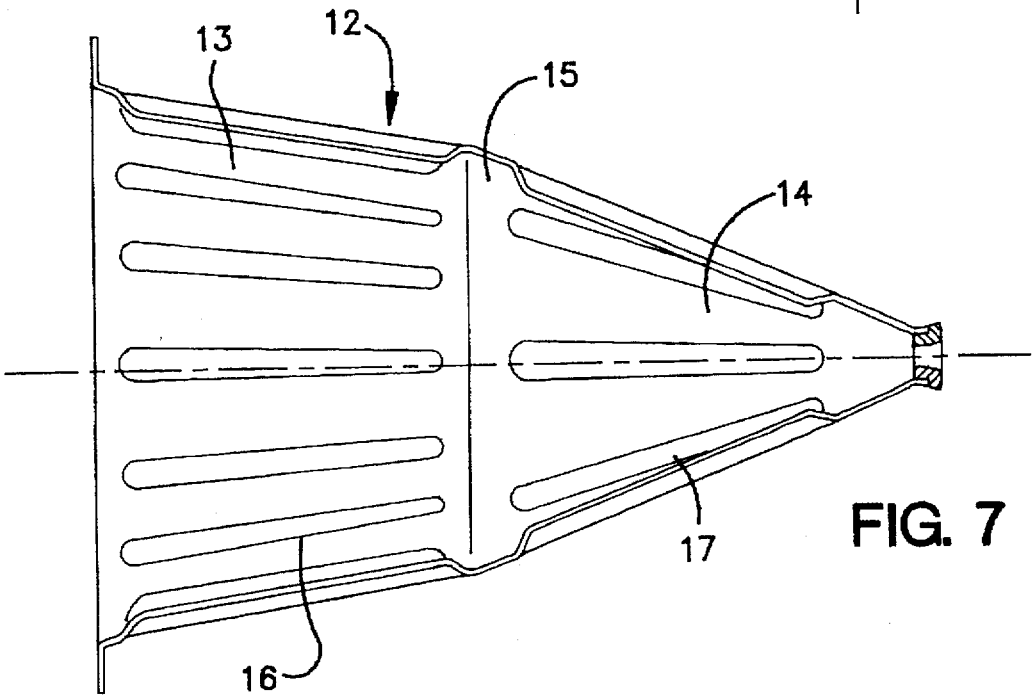
FIG. 7 is an external view of another embodiment of the antiballoon device according to the present invention.

FIG. 7 shows an alternative embodiment of the antiballoon device according to the invention. As seen, said device consists of an ailment 12 formed by associating two frustoconical surfaces 13 and 14, of different taper, through an intermediate radiusing surface 15. Ribs 16 and 17, formed on the intrados of each of the surfaces 13 and 14, extend along the generatrices of said surfaces, while the radiusing surface 15 is smooth and comprises no ribs or projections.

Figure 8:
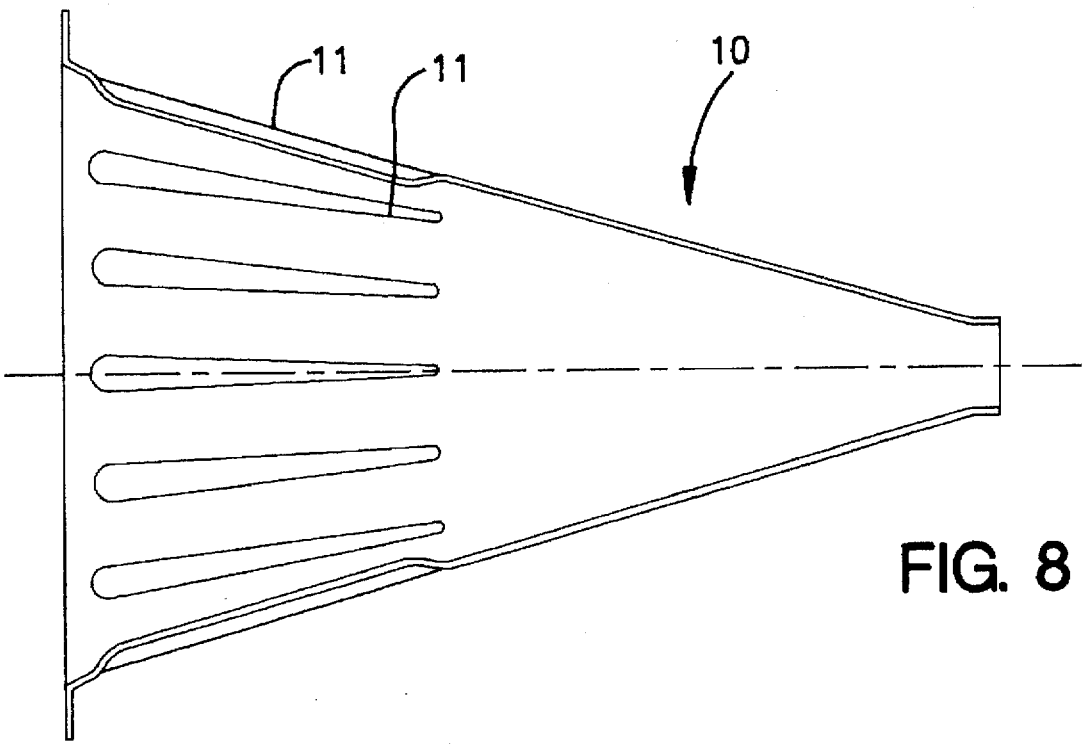
FIGS. 8&9 show the varying projection of claim 9 and the slight rib inclination of claim 4, respectively.
Figure 9:
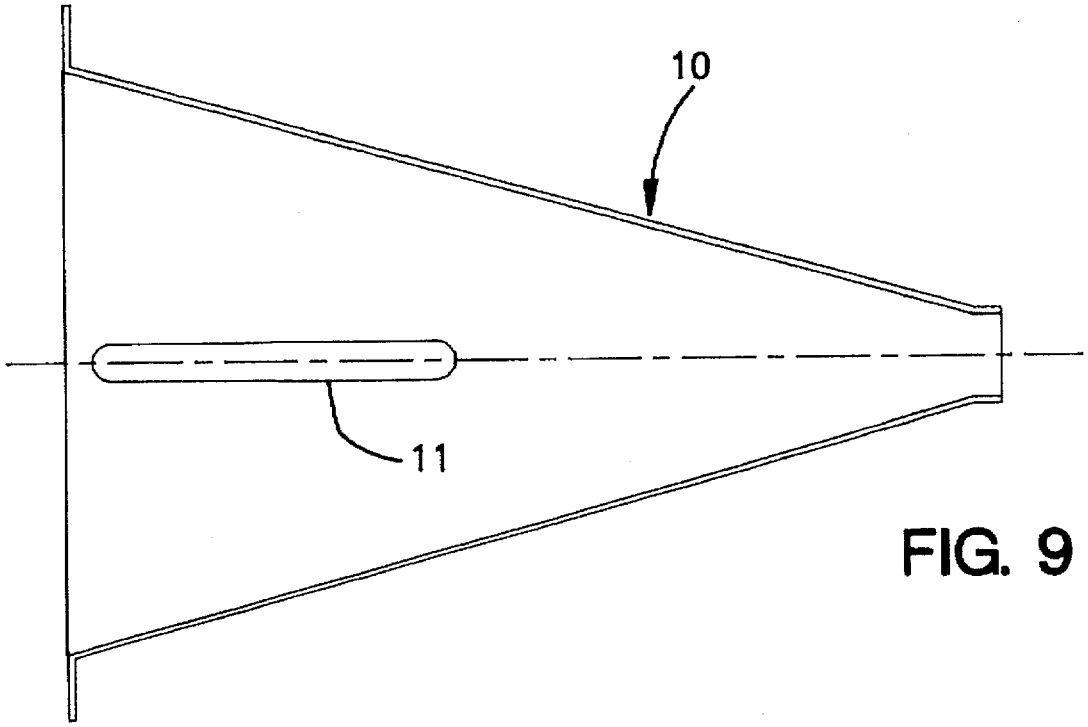

Many other embodiments of the invention are of course possible, or variant could be introduced in the ones already described. For instance, as previously mentioned, the ribs—which, in the described embodiments are shown with a constant section, uniformly projecting from the intrados of the element forming the device and extending exactly along the generatrices of its surface—could instead be slightly inclined in respect of said generatrices (FIG. 9), could project from said surface to a variable extent over their length (FIG. 8), and could even vary in section or shape. Likewise, instead of one or more sets of ribs evenly distributed over the directrices of the surface of said element—as in the described embodiments—groups of ribs could be unevenly distributed over the directrices of said surface.

Furthermore, instead of a single homogeneous set of ribs 11—as in the embodiment of FIG. 5—or of two distinct homogeneous sets of ribs 16 and 17—as in the embodiment of FIG. 7—the device could comprise more sets of ribs, equal or different, possibly penetrating into each other.

It is understood that all these variants fall within the protection scope of the present invention.

We claim:

1. Antiballoon device for weft yarn feeders of looms to control the yarn at an outlet of said yarn feeders, comprising an element having a substantially frustoconical surface, wherein a plurality of ribs project from an inner wall of said element, said ribs extending substantially along lines of said frustoconical surface which pass through an apex of said frustoconical surface, each of said ribs being separated from adjacent said ribs by an area of said inner wall of said element.

2. Device as in claim 1, wherein said ribs extend through at least half of the length of said frustoconical surface.

3. Device as in claim 1, wherein said ribs extend exactly along said lines passing through said apex.

4. Device as in claim 1, wherein said ribs are slightly inclined in respect of said lines passing through said apex.

5. Device as in claim 1, wherein said ribs are distributed in a uniform manner, or in sets, around a periphery of said surface.

6. Device as in claim 5, wherein the ribs of one or more sets extend exactly along said lines passing through said apex, and said ribs of other sets are slightly inclined in respect of said lines passing through said apex.

7. Device as in claim 1, wherein each rib projects with a uniform section and to a constant extent from the inner wall of said substantially frustoconical element.

8. Device as in claim 1, wherein at least part of said ribs project with a varying section and to a variable extent from the inner wall of said substantially frustoconical element.

9. Device as in claim 1, wherein said substantially frustoconical element comprises two frustoconical surfaces of different taper, through an intermediate smooth radiusing surface, said ribs being disposed upon each of said frustoconical surfaces.

* * * * *